United States Patent [19]

Schoeffler

[11] Patent Number: 4,597,454

[45] Date of Patent: Jul. 1, 1986

[54] CONTROLLABLE DOWNHOLE DIRECTIONAL DRILLING TOOL AND METHOD

[76] Inventor: William N. Schoeffler, 218 W. Bridge St., Breaux Bridge, La. 70517

[21] Appl. No.: 619,866

[22] Filed: Jun. 12, 1984

[51] Int. Cl.[4] ..... E21B 7/04

[52] U.S. Cl. ..... 175/61; 175/73; 175/256

[58] Field of Search ..... 175/45, 61, 73, 74, 175/75, 256, 320; 285/184, 282

[56] References Cited

U.S. PATENT DOCUMENTS 4,303,135 12/1981 Benoit ..... 175/73

4,522,272 6/1985 Beingraben ..... 175/61

FOREIGN PATENT DOCUMENTS 205740 2/1968 U.S.S.R. ..... 175/61

*Primary Examiner*—Stephen J. Novosad

*Assistant Examiner*—William P. Neuder

*Attorney, Agent, or Firm*—Pravel, Gambrell, Hewitt & Kimball

[57] ABSTRACT

An improved directional drilling tool permits the control of the angle of drilling of a drill bit through the repeated placement or removal of a ball within the mudstream. The ball activates, clutch mechanism within the directional drilling tool. The clutch mechanism, controlled by the activated valve, locks the exterior of the directional drilling sub to a fixed angular orientation and activates a deflection cam to deflect a drive shaft so as to angle the bit, causing the bit and sub to drill at a controlled angle offset from the vertical. The unit is aligned and located using wire line measuring equipment of known design. Since the sub may be controllably set in a straight line drilling or an angle drilling position, it may be left permanently in position in a drill string significantly reducing the requirement to trip out the well bore during directional drilling and significantly increasing the flexibility available to the driller to deflect the direction of drilling while drilling is in progress.

9 Claims, 7 Drawing Figures

CONTROLLABLE DOWNHOLE DIRECTIONAL DRILLING TOOL AND METHOD

BACKGROUND OF THE INVENTION

Both the cost of maintaining a drilling rig for such purposes as drilling oil wells and the complexity of underground formations encountered in deephole drilling, have led to the need for the ability to drill multiple, angled or deflected drill holes from a single drilling platform.

This process of directional drilling has involved improvements and innovations both in the construction of the actual drilling subs and drill bits for use at the bottom end or drilling end of a drill string as well as significant improvements in the instrumentation necessary to control and monitor the downhole progress of the drilling.

For the purposes of this patent application, it is necessary only to point out that within the arts technique known as wireline tools have been devised. These tools, which are lowered through the inner tubular region of a drill string to a point adjacent the actual drilling bit permit monitors on the surface or floor of the drill rig to determine the angle, depth, and general environmental conditions being encountered by the drill bit. In particular, it is possible, using current wireline technology to establish orientation within a downhole drilling sub and to determine positively the existing downhole rotational orientation and angle of drilling orientation at any point within the drilling process.

Drilling subs or directional drilling currently known to the art are two major constructions. In the first, designed principally for use when the rotation energy imparted to a drill that is imparted by rotating the entire drill string from rotation imparted by a rotating table installed on a drill rig floor, or angled subs; that is, the drilling sub is constructed at a permanent offset so that rotation entered at the top of the sub is angled and proceeds to rotate the drill bit at an offset angle at the bottom of the sub. These units are in essence very large analogs to an angled drive collet known in the drill art and machine shops and the like. In order to engage in drilling using such a sub, the entire drill string must be tripped out, the appropriate angled sub installed, the drill string re-entered into the bore and drilling using the angled sub commenced. The total amount of deflection is the function of the distance drilled while the angled sub is installed. When the desired deflection has been achieved, the entire drill string must again be tripped out, the angled sub removed, and straight subs re-installed so as to permit continued straight line drilling at the new, deflected direction.

In the field of downhole drill motors, such as the turbine drilling devices, driven by mudflow and the like, it is possible to create an angled deflection by controlling the flow of the mud preferentially out one portion of the drill bit. Such apparatus are known, and are widely used.

The primary cost and difficulty encountered in current art directional drilling devices is the general necessity that for each change of direction at least two trips of the drill string are required to install and remove the directional drilling apparatus. Such drill string activity is nonproductive, considerably slows the drilling process, and introduces other problems such as drill string sticking, possible hole collapse and the like, all of which are well known to the art. It is therefore considered higly desirable that the number of trips of the drill string during the drilling operation be minimized, and that the amount of time actually spent drilling be maximized. This is especially true on an offshore platform where all the wells drilled are usually drilled from an initial starting bore and where the success of the offshore drilling platform is totally dependent upon the ability to engage a multiple directional drilling.

SUMMARY OF THE INVENTION

A novel directional drilling tool is shown adapted to installation immediately above the drill bit. Within the tool is contained a rotating driving or torquing tube running substantially the length of the interior of the tool's housing. This shaft conducts the rotating torque of the drill string from the tool's connecting socket with the drill string to the actual drill bit. Also contained within the tool is an angled cam mechanism, driven by switchable mud pressure from the drill mud flow. The angled cam bears upon a rotating midpoint of the drive shaft so that as the angled cam is activated it deflects the drive shaft to the side of the interior of sub, and thereby deflects the drill bit connected to the lower end of the drive shaft through a rotating drive joint. This deflection in turn causes the entire tool to drill at an angle, creating the desired deflected drilling.

A drive clutch mechanism, of a particular design to permit control and repeatability of the orientation of the outer housing wall of the tool is also activated by a mud-driven valving mechanism so as to in the first position permit rotation of the outer housing of the tool so as to rotatably align the cam mechanism to a given direction, and when activated to a second position to decouple the housing wall of the tool together with the cam mechanism from rotation so as to maintain a given offset angle of drilling.

Inasmuch as the novel tool is capable of drilling both at a deflected angle and as a straight ahead drilling tool, there is no necessity of removing the tool from the bottom of the drill string, the tool thereby is capable of being used for substantially the entire period of time the drilling operations are engaged in and need be removed only as would be required for removing he drill bit.

Likewise, the tool is particularly adapted to monitoring with wire line so as to establish a given rotational position, the sub thus controls the direction of drilling by controlling a rotational azimuth, allowing the azimuth to be established by an activation of the coupling clutch before described and also by establishing an offset angle in a second plane about the axis of rotation or offset from the axis of rotation of the tool.

The controlling clutch mechanism which activates the tool is driven by the pressure of mudflow from the continuous flow of drilling mud and fluid within a drill string. The mudflow is diverted to activate the controlling clutch by a ball controlled valve mechanism which is activated to a angled drilling position by dropping a ball in the mudflow through the center of the drill string. This ball is readily removed using standard downhole ball activated technology. The design of the activating valve is such that positive activation of the clutch produces a sensible change in the pressure and flow rate of the drilling mud and thus positive activation of the directional drilling device may be readily ascertained by the drilling operator.

It is thus an object of this invention to provide an improved downhole drilling tool capable of controllably drilling a straight or a deflected hole.

It is a further object of this invention to provide a downhole directional drilling tool whose angle of drilling may be readily monitored using existing wireline technology.

It is a further object of this invention to provide a directional drilling tool which may be alternately set using existing downhole sub control technology from a straight ahead to an angled drilling position.

It is a further object of this invention to provide a downhole drilling tool which gives a positive indication of the drilling floor of its actuation to a deflected or a straight ahead drilling sequence.

These and other objects of this inventions will be readily apparent to those skilled in the art from the detailed description and claims which follow.

DETAILED DESCRIPTION OF THE PREFERRED EMBODIMENT

Figure 1:
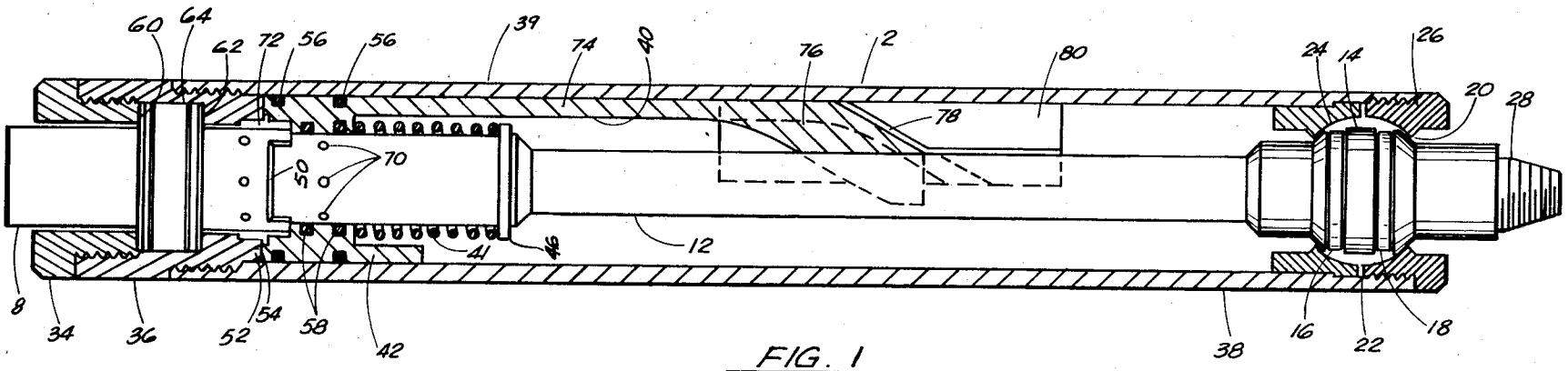
FIG. 1 is a cut-away section view of the invention in a straight line drilling position.
Figure 3:
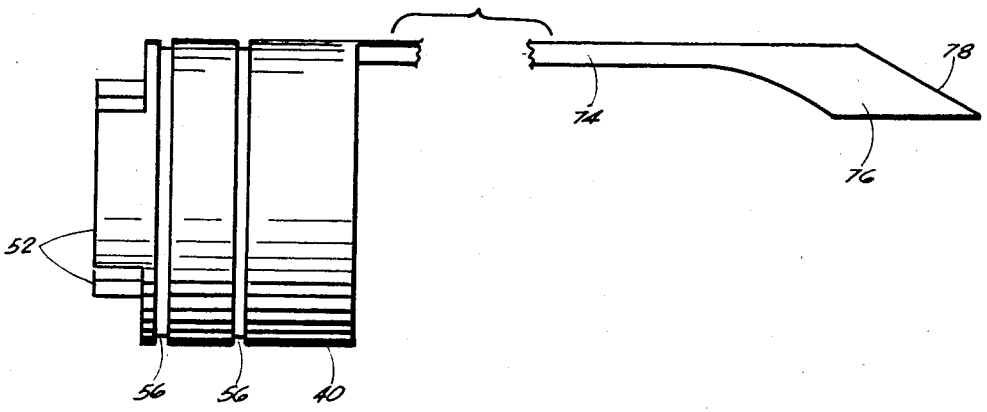
FIG. 3 is a partial view of the cam driving shaft and yolk in the present invention.
Figure 2:
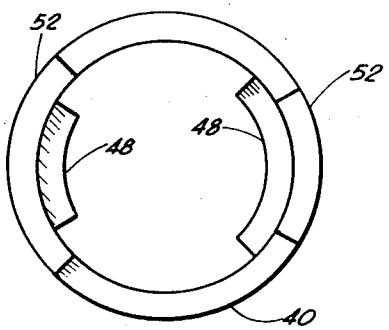
FIG. 2 is a top view of the clutch mechanism of the present invention.
Figure 4:
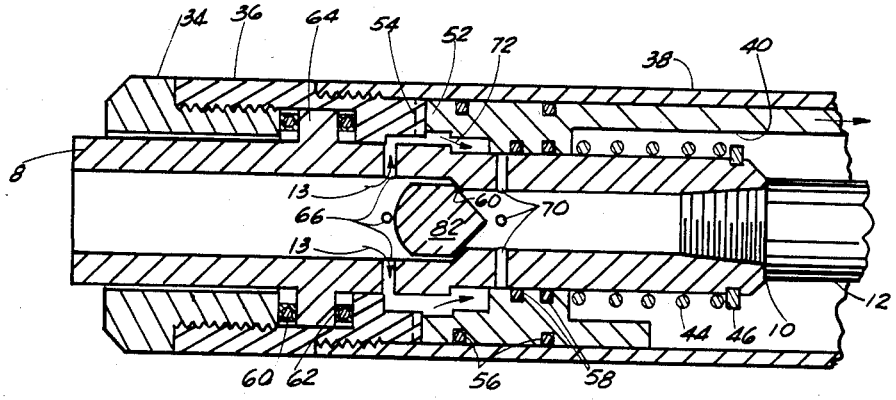
FIG. 4 is a side cut-a-away view of the mud pressure activation chamber of the present invention.
Figure 5:
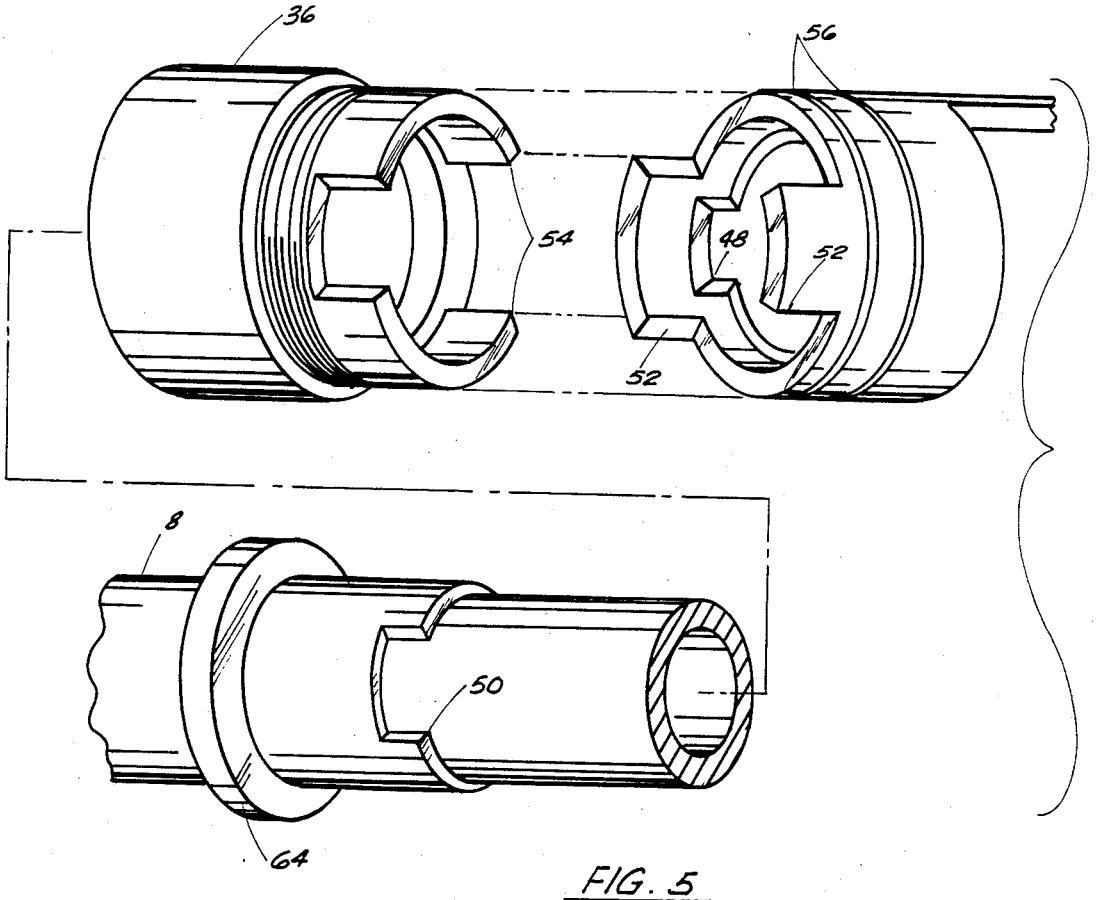
FIG. 5 is an exploded view of the clutch mechanism of the present invention.
Figure 6:
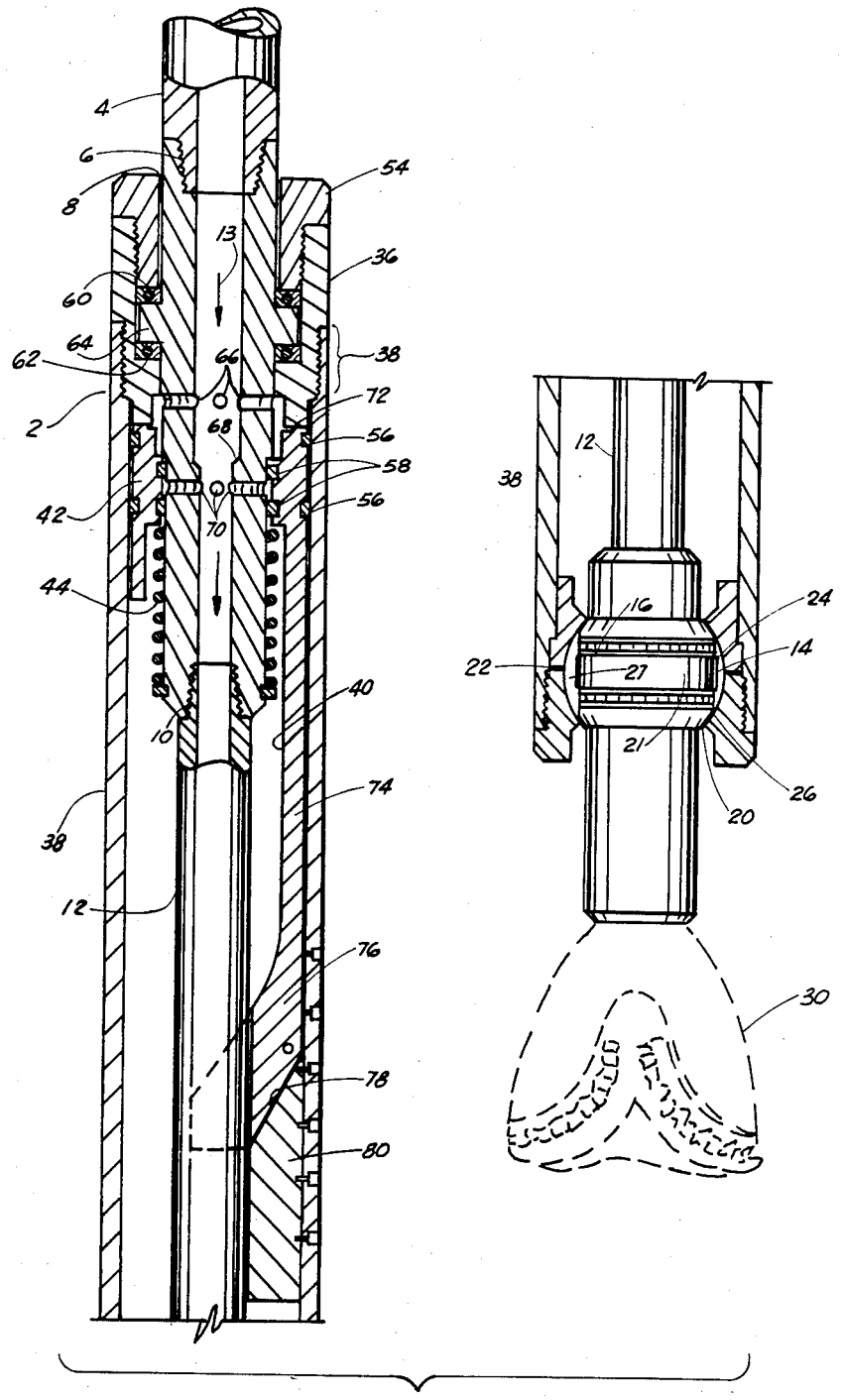
FIG. 6 is a cross-sectional view of the invention in the straight-line drilling position.
Figure 7:
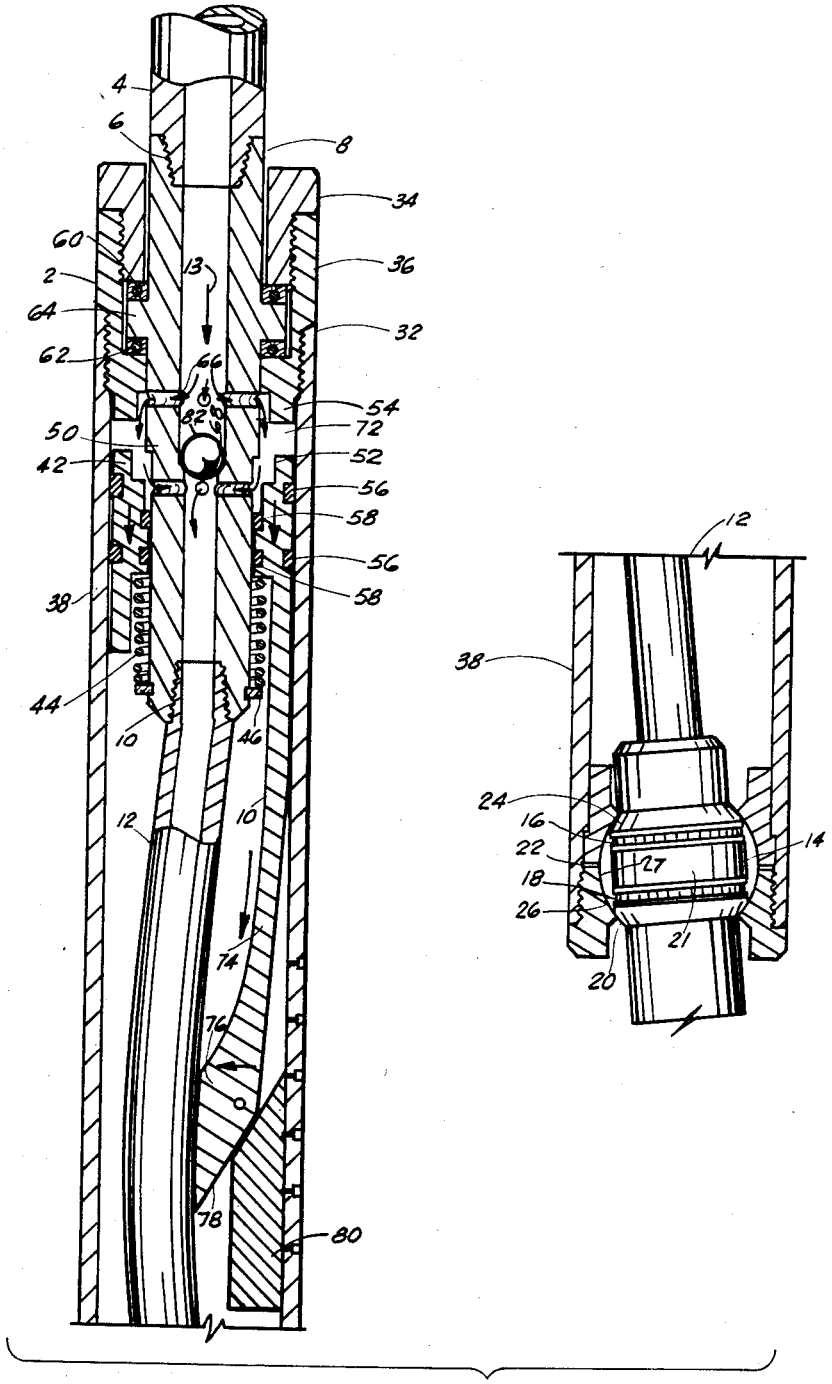
FIG. 7 is a cross-sectional view of the present invention in the second deflected position.

Referring principally to FIG. 1 the inventive drilling tool 2 of the current invention is shown as connected to a driving string 4 extending downward as a standard drill string well known to the art. The drill's driving string 4 is connected into the directional sub 2 by means of an API pin and socket joint 6, constructed as a tapered screw and socket joint to the American Petroleum Institute's standard for joints and drill strings.

Rotatably connected through API pin and socket joint 6 to driving string 4 is drive tube assembly 8. Drive tube assembly 8 is an essentially hollow, cylindrical tube assembly extending, rotatably connectably between the API pin and socket joint 6 to internal rotating pin joint 10.

Internal pin joint 10 is a reversed or inverted tapered screw pin and socket joint rotatably connecting drive tube assembly 8 to cylindrical deflection drive tube 12. An essentially hollow tubular passage 13 adrafted to drilling mudflow extends vertically down the center axis of drive tube assembly 8 and deflection drive tube 12. Mud flow passage 13 is flowably connected to an identical mud flow passage found within driving string 4 and in turn connects flowingly for mud to drill bit 30 as will be described.

At a bottom end of deflection drive tube 12 is found angularly displaceable lower thrust bearing assembly 14. Angularly displaceable thrust bearing 14 is comprised in the current embodiment of the invention of a first thrust bearing 16 and a second thrust bearing 17 circumferentially emplaced on rotating compliant bearing ball 20. First thrust bearing 16 and second thrust bearing 18 are installed parallel to each other equal-distantly spaced from and centering between themselves rotating compliant ball pivot point 21. First thrust bearing 16 and second thrust bearing 18 further support rotating compliant ball 20 against bearing socket 22.

Bearing socket 22 comprises an upper curved bearing support collar 24 and a split, lower curved bearing support collar 26. Each of bearing support collar 24 and bearing support collar 26 have an internally curved arcuate face 27. Arcuate face 27 on each of upper curved collar 24 and lower curve collar 26 are inverted to one another to form thereby a continuous essentially circular arch surface, supporting rotatably first thrust bearing 16 and second thrust bearing 18 for sliding. Curved arcuate face 27 is thereby essentially circumferentially positioned about pivot point 21.

At a lower end of deflective drive tube 12 is found a standard drive joint 28 of the style of joint well known to the art for connecting to a drill bit 30; drill bit 30 is of any of a standard designed drill bit for drilling an oil well or the like and, as is know, is provided with a receiving mud flow passage for receiving mud from mud flow passage 13.

The essentially columnar rotating assembly comprising drive tube assembly 8 and deflection drive tube 12 defines a vertical axis of rotation and a cylindrically inserted within an outer subcasing assembly 32. Outer subcasing 32 in turn comprising an upper collar piece 34 defining an upper end to casing assembly 32 cylindrically extending downward from and fixedly attached to upper collar piece 34 is outer casing clutch cylinder 36. Clutch cylinder 36 presents on its exterior a continuing cylindrical surface adapted to fitting within a drill hole bore in the manner of a standard drilling sub and on its interior provides a clutch member for coupling outer casing assembly 32 to drive tube assembly 8 in a manner to be described.

Fixedly connected to clutch cylinder 36 and extending cylindrically down there from at a uniform diameter to clutch cylinder 36 is outer casing cylinder 38. Outer casing cylinder 38 defines essentially the majority of the length and outer periphery of the overall directional sub 2.

At a lower end of outer casing cylinder 38 are found fixedly attached by screw threads in the preferred embodiment or the like, upper curved bearing collar 24 which is circumferentially inserted within an interior of outer casing cylinder 38 and lower bearing collar 26 which is also fixedly disposed extending upward within cylinder 38 fixedly connected thereto, spacedly supported from upper curved collar 34 so as to maintain the before described proper curvature to curved arcuate faced 27.

Outer casing cylinder 38 is essentially hollow for its internal length containing therein deflection tube and clutch and deflection assembly 40. Deflection tube clutch and deflection assembly 40 comprises a second spring-loaded cylindrical self-aligning spline clutch member 42. Spline clutch member 42 is spring-loaded by spring 44 against spring retaining collar 46 upon a lower outer periphery drive tube assembly 8. Spring 44 retaining collar 46 reacts so as to provide a substantially upward bias on spline clutch member 42. Spline clutch member 42 in turn engages with first nondisengaging internal spline coupling 48 to a provided circumferential face driving spline 50 circumferentially disposed around drive tube assembly 8.

Clutch member 42 also disposes second outer self-aligning spline clutch member 52 engaging to mating self-aligning drive spline 54 disposed about the lower face of outer casing upper clutch cylinder 36. Angularly disposed, circumferentially about 2 points upon clutch member 42 are first and second ring seal means 56 sealingly disposed against the inner wall of outer casing cylinder 38.

Interiorly disposed angularly within spline clutch member 42 are first and second inner ring seal means 58 sealingly disposed against the outer cylindrical surface of drive tube assembly 8.

Drive tube assembly 8 is supported for rotation above clutch member 42 by rotating bearing assembly 60. In the preferred embodiment of the invention bearing support member 60 comprises two parallel thrust bearings circumferentially installed upon drive tube 8, bearing for thrust upwardly against upper collarties 34 and downwardly for thrust against thrust shoulder 62 of outer case clutch cylinder 36. Drive tube assembly clutch collar 64 supports said first and second bearing forming thereby rotating bearing support member 60.

As stated, mud flow passage 13 extends axisuedly within drive tube assembly 8 at a first upper point on drive tube assembly 8, immediately above circumferential faced driving spline 50 are found a polarity of mud flow passages 66. Within mud flow passage 13, immediately below first mud flow passages 66, the diameter of mud flow passage 13 is necked in by flow shoulder 68 providing thereby an effective restriction to the passage of objects occupying the full diameter of mud flow passage 13. Immediately below flow shoulder 68 are found second mud flow passages 70. A polarity of mud flow passages, essentially equal in number and area to that of upper mud flow passages 66 are provided communicating between mud flow passage 13 and the exterior of drive tube assembly 8.

A mud pressure activation chamber 72 is formed within an angular area defined by outer casing cylinder 38, the lower end of outer clutch cylinder 36, the upper end of spline clutch member 42 and the outer surface of drive tube assembly 8, in an angular region connectingly adjacent to circumferential face driving spline 50.

Driveably extending downward from spline clutch member 42, interiorly and fixedly extending within the angular region between the interior of outer casing cylinder 38 and deflection drive tube 12 is deflection cam driving shaft 74.

At the lower end of deflection cam driving shaft 74, shaft 74 continuously expands into cam yoke member 76. Cam yoke member 76 forms a bifurcaded sliding free yoke surrounding and rotationally supporting at least one side of deflection drive tube 12.

Cam yoke member 76 has an angled lower face 78 position for sliding deflecting motion against cam block 80. Cam block 80 is an angled deflecting block having a substantially downward facing angular connecting cam angle lower face 78 and fixedly attached to outer casing cylinder 38 at a point essentially adjacent to a point intermediate the ends of deflection drive tube 12.

In operation the directional drilling sub 2 is installed, as is well understood to the art through API pin and socket joint 6 to an existing drill string for drilling immediately above the drill bit 30. The drill bit 30 is installed by connection to drill bit drive joint 28 to a lower end of directional sub 2.

Drill bit 30 is activated for drilling by the rotation of overall driving sting 4. The rotation of driving string 4 rotatably connected to pin and socket joint 6 rotates drive tube assembly 8. Drive tube assembly 8 through internal pin joint 10 rotates deflection drive tube 12, which is in its normal position a substantially straight tube member. Deflection drive tube 12 rotates through drive joint 28 drill bit 30 thus acting to drill an oil well bore hole.

The pressure of spring 44 against retaining collar 46 and spline clutch member 42 causing spline clutch member 42 to clutchedly aligned by engagement of splines through first spline clutching means 48 to the circumferential face driving spline 50 on drive tube assembly 8. Thus drive tube assembly 8 rotates spline clutch member 42. In turn spline clutch member 42 through self-aligning spline clutch 52 and 54 rotates outer casing clutch cylinder 36. Outer clutch casing cylinder 36, being fixedly connected to upper collar piece 34 and outer casing cylinder 38 rotate both outer casing cylinder 38 and upper collar piece 34. In this manner the entire directional sub 2 rotates during straight drilling within the bore hole.

When it is desired for directional drilling to commence a control ball or activating ball member is inserted within the mud flow within the driving string 4. Driving ball 82 passes through the driving string 4 mud flow passage and into mud flow passage 13 of drive tube 8, but is chosen of a diameter such that it cannot pass flow shoulder 68. Ball 82 engages flow shoulder 68 blocking substantially mud passage 13 for the flow of mud through drive tube assembly 8. The mud pump pressure thus forces substantially the entire flow of drilling mud through passages 66 into mud piston activation chamber 72 applying thereby a substantial down hydraulic pressure against the upper shoulder of spline clutch member 42. Inasmuch as spline clutch member 42 is the only member free to move against the restraining force of spring 44, it is deflected downward compressing spring 44 and disengaging thereby first spline coupling means 48 from face driving spline 50 and and second spline clutch 52 from spline clutch mating 54. This downward motion of clutch member 42 proceeds until lower mud flow passages 70 are open for flow causing mud flow to re-enter mud passage 13 and continue down to drill bit 30. The reduced area of mud flow passages 66 and mud flow passages 70, however, causes a significant, sensible increase in the overall pressure and resistance to mud flow and a decrease in the quantity of mud pumped at a given pump pressure thus providing a positive indication to a drilling controller upon the drill rig floor of the activation of clutch 42.

Clutch 42 in moving to its downward position drives cam driving shaft 74 in a downward direction. Cam yoke member 76, coupled by angled lower face 78 against cam block 80 is driven down against cam block 80 and by the interaction of lower face 78 against cam block 80 is deflected away from casing cylinder 38 and towards the center axis of deflection drive tube 12. Deflection drive tube 12 is a substantially deflectable tube supported only at its ends. And the force of yoke 78 deflects drive tube 12 in the middle causing drive tube 12 to enter angularly displaceable lower thrust bearing 14 at an angle differing from vertical. In the preferred embodiment of the invention the deflection angle approaches two-thirds to one degree of angular deflection.

Bearing 14, comprising primarily rotating compliant ball 20 and first and second thrust bearing 16 and 18 is free to rotate to a degree within the bearing socket 22 formed by upper curved collar 24 and lower curve collar 26. Compliant ball 20 rotate in response to the deflection of tube 12 changing the angle of drill bit 30 with respect to the center axis of outer casing cylinder 38 by deflection amount established by the downward travel of cam yoke member 76 upon the activation of spline clutch member 42 by mud pressure.

This activation provides a known fixed and constant offset angular deflection for drill bit 30.

It will be recalled that the activation of clutch member 42 disengaged spline coupling means 52. This disengagement as can be seen decoupled the means by which outer casing cylinder 36 was rotated by the rotation of driving string 4. Driving casing cylinder 36 is maintained in a nonrotation condition by friction to the bore walls, augmented by optional stabilizer members 82 disposed about the outer surface of cylinder 38. Thus with respect to a given drill hole or bore during the straight line drilling permits the rotation of casing cylinder 38 and thereby the azimuthial rotation of cam yoke member 76 and cam block 80. By means of known wireline technology, the exact azimuthical position of sub 2 can be determined. Thus by manipulation of the rotation of driving string 4 the azimuth or compass angle of deflection to be produced by drive sub 2 can be established. As described above, upon activation of the deflection by activation of the clutch member 42 outer casing member 38 is substantially engaged against the bore hole against rotation preserving this azimuth orientation. Thus the two or one activated provides a fixed angular offset at a controllable azimuth, providing thereby a controlled offset drill.

Drilling is continued in the controlled offset mode until the desired second direction of drilling is established. At which point a wireline ball removal tool, well known to the art, is lowered to remove the activating ball from against flow shoulder 68. The removal of activating ball 82 restores mud flow through passage 13 and the spring action of spring 44 return spline clutch member 42 to an engaged position.

Second self-aligning spline clutch 52 and mating spline 54 are constructed of a nonsymmetrical spline face having one wide and one narrow spline member which permits only one direction of engagement of re-engagement of the spline clutch. This re-engagement preserves the azimuthical or rotational angle orientation of the outer casing cylinder 38, the outer casing clutch cylinder 36 and the spline clutch member 44 with its attached cam driving shaft 24 and cam yoke member 76. This insures that the deflection controlling members of the sub 2 are maintained at a constant angular position with respect to the overall driving string 4. Once the string 4 is made up with the directional sub 2 and is essential for preserving the ability to repeatedly control directional drilling downhole without the necessity of tripping out the string or pulling the directional sub for re-alignment.

It can be seen from this description of the preferred embodiment of the invention and the claims which follow that this invention is susceptible to a number of variance within its construction and control means. Therefore this detailed description should not be viewed as limiting but the invention rather encompasses all those equivalent embodiments as claimed.

I claim:

1. A tool for controllable, directional drilling in a deep bore well comprising:

a. an elongate, outer, orientable casing member, aligned in said bore;

b. an inner, bendable, torque passing member adapted for rotation of a drill bit, journaled within said outer casing member;

c. means for deflecting, with respect to the orientation of the outer casing member, the inner bendable torque passing member; and d. means having a first coupled position, coupling the outer casing member and said inner bendable member, and a second uncoupled position disconnecting the outer casing member and the inner bendable member.

2. An apparatus as described in claim 1 above, wherein said inner bendable member further comprises:

a. an elongate, deflectable tube member adapted for rotation;

b. means for coupling for rotation a drill bit to an end of said tube member, orienting said drill bit to an angle established by said tube member.

3. An apparatus as described in claim 2 above, wherein said means for rotatably connecting said drill bit further comprise:

a. an angularly variable rotating thrust bearing member rotationally supporting said tube member within said outer casing member, adjacent said drill bit.

4. An apparatus as described in claim 1 above, wherein said means for deflecting said tube further comprise:

a. means, actuatingly connected to said outer casing member for rotational orientation, rotationally supporting said inner bendable member, having a first supporting position wherein said inner bendable member is substantially straight, and having a second supporting position wherein said inner bendable member is substantially curved; and b. means for transitioning said first means between said first and said second positions.

5. An apparatus as described in claim 4 above, wherein said second means further comprise control means comprising:

a. means for diverting a flow of drilling fluid from a first to a second flow path;

b. piston means, responsive to mud flow in said second flow path, actuated by said mud flow from a first biased position to a second actuated position; and c. cam means, actuated by movement of said piston from said first to said second position, activating said deflection supporting means.

6. An apparatus as described in claim 5 above, wherein said control means further comprises:

a. first bypass passages connecting between said first mudflow path and said second mudflow path;

b. said second mudflow path comprising an annular space between said inner bendable member and said outer casing member;

c. actuatable mud flow restriction means, forcing upon actuation mud through said first bypass passages into said annulus;

d. a surface component of said annulus means movable with respect to all other surface portions of said annulus, being movable in response to said mud flow within said annulus;

e. means for biasing said movable surface to a first position; and f. second bypass passages for returning mud to said first mudflow path upon movement of said annulus surface to a second position.

7. An apparatus as described in claim 1 above, wherein said clutch means further comprises:

a. first spline connecting means, being slidably disengagable to a second position circumferentially enclosing said inner bendable tube;

b. second spline connecting means slidably retaining engagement, during movement of first said spline engaging means, adapted for retaining orientation of said outer casing member and said deflecting means; and b. said splines being of a larger and a smaller tooth, having only one aligned rotational relationship for engagement.

8. An apparatus for removably coupling an outer casing member in an inner rotating member within a drilling tool, retaining relative alignment for engaged use, comprising:

a. clutch means, engaging and disengaging the outer casing member and the inner rotating member;

b. controllable means for actuating the clutch means, the controllable means further comprising:

i. first bypass passages connecting a first mud flow path and a second mud flow path;

b. actuatable mud flow restriction means, forcing, upon actuation, mud through the first bypass passages into the second mud flow path;

c. a surface component position in the second mud flow path movable in response to the mud flow within the second mud flow path; and e. means for biasing the movable surface member to a first position and second bypass passages for returning mud to the first mud flow path upon movement of the surface component to a second position.

9. A method for directional drilling comprising:

a. providing an outer, rotationally alignable, bore contacting alignment means;

b. providing an inner deflectable drive means having a first straight line and a second curve driving position;

c. providing means for rotationally coupling and uncoupling the outer, rotationally alignable bore contacting alignment means and inner deflectable drive means;

d. rotatably connecting a drill bit to said deflectable drive means, angularly responsive to said deflection;

e. aligning said outer means to establish an azmuth of said drilling direction; and f. deflecting said drive means to establish an offset drill arc angle along said azmuth.

* * * * *